US006527311B1

(12) United States Patent
Burke et al.

(10) Patent No.: US 6,527,311 B1
(45) Date of Patent: Mar. 4, 2003

(54) DOOR LOCK FOR A RAILROAD CAR

(75) Inventors: Michael K. Burke, Wheaton, IL (US); Walter J. Peach, South Elgin, IL (US); Jake C. Pedersen, Wheaton, IL (US)

(73) Assignee: ZefTek, Inc., Montgomery, IL (US)

( * ) Notice: Subject to any disclaimer, the term of this patent is extended or adjusted under 35 U.S.C. 154(b) by 0 days.

(21) Appl. No.: 09/951,803

(22) Filed: Sep. 12, 2001

Related U.S. Application Data

(60) Provisional application No. 60/233,326, filed on Sep. 15, 2000.

(51) Int. Cl.[7] ..... E05C 1/12

(52) U.S. Cl. ..... 292/171; 292/DIG. 57; 292/DIG. 32

(58) Field of Search ..... 292/138, 163, 292/164, 141, 171, 175, DIG. 57, DIG. 32

(56) References Cited

U.S. PATENT DOCUMENTS

| | | | | |
|---|---|---|---|---|
| 1,910,102 A | * | 5/1933 | Godfrey | |
| 2,231,188 A | * | 2/1941 | Iarrobino | 292/138 |
| 3,193,335 A | | 7/1965 | Wing | |
| 3,912,312 A | | 10/1975 | Cerutti | |
| 3,995,563 A | | 12/1976 | Blunden | |
| 4,461,160 A | * | 7/1984 | Gompel | 70/100 |
| 4,909,638 A | | 3/1990 | Muto | |
| 4,917,021 A | | 4/1990 | Murphy | |
| 5,020,425 A | | 6/1991 | Kelly | |
| 5,072,880 A | | 12/1991 | McCloud | |
| 5,145,265 A | | 9/1992 | Flem | |
| 5,482,987 A | | 1/1996 | Forschirm | |
| 5,520,466 A | | 5/1996 | Everitt et al. | |
| 5,829,317 A | | 11/1998 | Vreeken et al. | |
| 5,851,021 A | | 12/1998 | Van Kley | |
| 6,086,327 A | | 7/2000 | Mack et al. | |

OTHER PUBLICATIONS

Diagrams of the Radial Door written by Thrall published Jul., 1989.

* cited by examiner

*Primary Examiner*—Gary Estremsky
(74) *Attorney, Agent, or Firm*—Bell, Boyd & Lloyd LLC

(57) ABSTRACT

The present invention reveals a lubricant-free door lock for railroad cars and particularly auto rack railroad cars, which eliminates the need to use grease or other lubricants to lubricate the door locks. The lubricant-free door lock generally includes a stainless steel cylindrical tube or housing and a cylindrical replaceable plastic bushing mounted in the housing the prevent the steel-on-steel contact between a locking pin and the inner walls of the housing. A washer or plate connected to the bottom end of the housing maintains the bushing in the housing. The door lock also includes a spring mounted in the housing between the bushing and an end cap positioned over the locking pin. A stop extends transversely through the housing, end cap and locking pin to limit the movement of the locking pin. The bushing eliminates the need for a lubricant between the steel locking pin and the steel inner walls of the housing.

48 Claims, 6 Drawing Sheets

FIG.4B
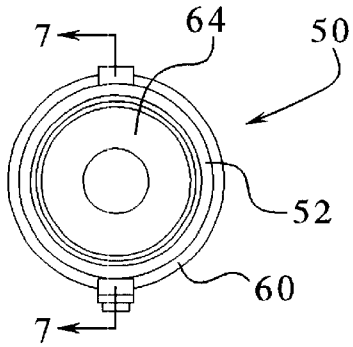
FIG.3
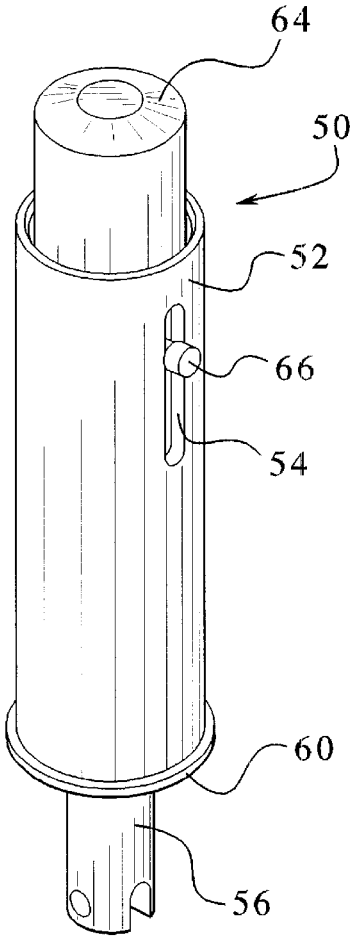
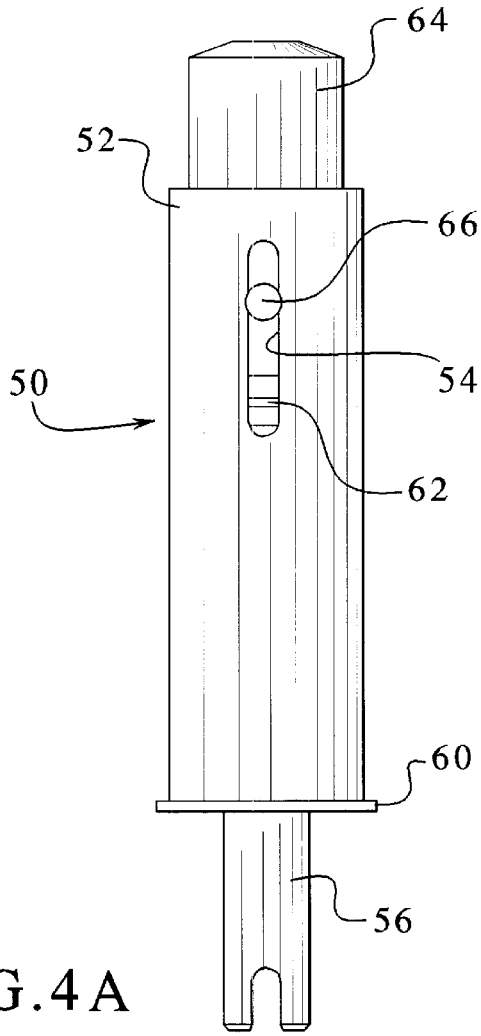
FIG.4A

FIG.5
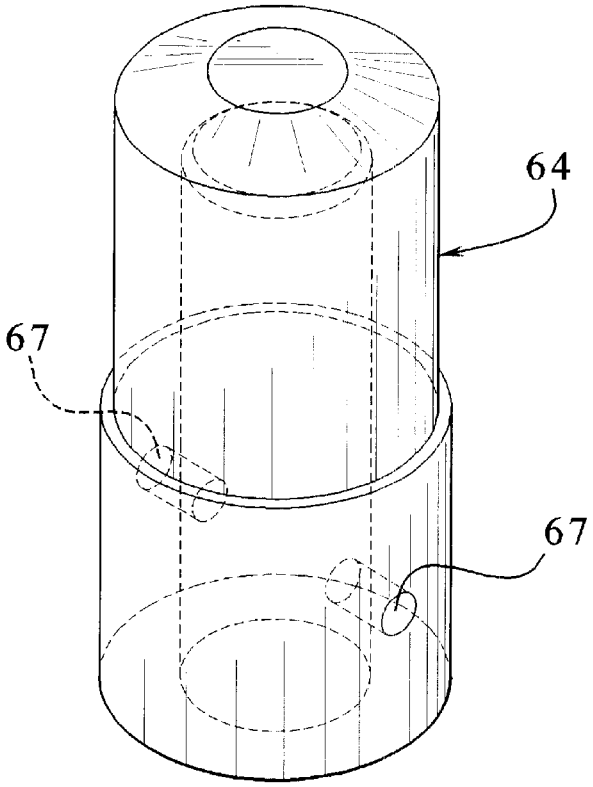
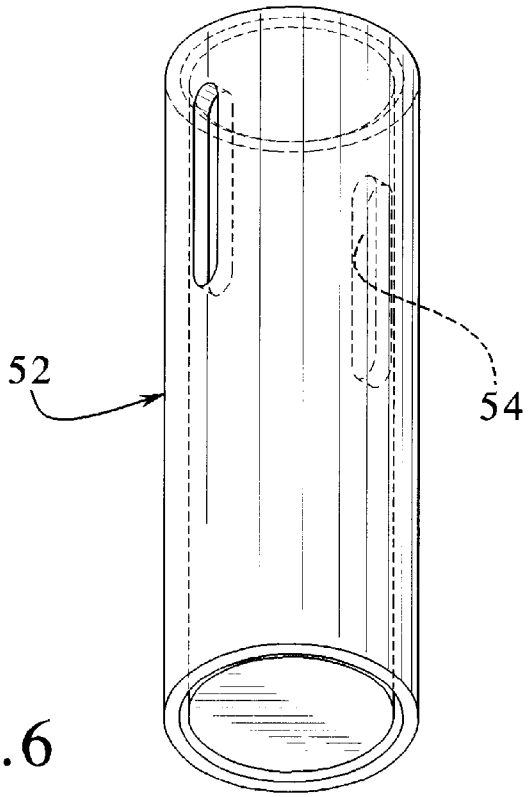
FIG.6

DOOR LOCK FOR A RAILROAD CAR

PRIORITY CLAIM

The present application claims the benefit of U.S. Provisional Patent Application No. 60/233,326, filed Sep. 15, 2000, the entire contents of which are hereby incorporated by reference and relied upon.

RELATED APPLICATIONS

This application relates to the following co-pending commonly owned patent application: "GREASELESS DOOR LOCK," Ser. No. 09/606,735.

DESCRIPTION

This invention relates in general to a door lock for a railroad car, and more particularly to a lubricant free door lock which is mounted on a door of a railroad car to secure the door in an open position or a closed position.

BACKGROUND OF THE INVENTION

The railroad industry employs a variety of railroad cars for transporting products. Many of these cars, such as boxcars or auto rack railroad cars, are enclosed to protect the products or vehicles being transported. Enclosed railroad cars generally include one or more sliding doors to provide access to the interior of the cars. The doors are generally mounted on upper and lower tracks which are attached to the frame of the car. The doors have conventional door locks to maintain the doors in an open position or a closed position. The conventional door locks must be lubricated with a standard lubricant such as grease. The grease attracts particles and other materials, generally creates a dirty environment and causes grease contamination in the interior of the cars.

This problem is especially undesirable in auto rack railroad cars which transport newly manufactured vehicles, including automobiles, vans and trucks. Auto rack railroad cars, known in the railroad industry as auto rack cars, often travel thousands of miles through varying terrain. The typical auto rack car is compartmented, having two or three decks or floors, a frame, two sidewalls, a roof and a pair of doors at each end of the car. The doors protect the auto rack car from illegal or unauthorized entry and prevent theft or vandalism of the vehicles. The doors also prevent flying objects from entering the car and damaging the vehicles. In transit, the doors are secured in the closed position. When the automobiles are being loaded or unloaded, the doors are secured in the open position. Examples of such doors for auto rack cars are generally illustrated in U.S. Pat. Nos. 3,995,563 and 4,917,021.

Each door in an auto rack car includes at least one door lock having a locking pin which engages a socket attached to the frame of the auto rack car. The grease and dirt builds up on these door locks, creates a dirty environment and causes grease contamination inside the auto rack cars which is highly undesirable for the transport of newly manufactured vehicles because the grease and dirt can damage the finishes of the vehicles. The grease also tends to drip or fall off the door locks onto the floor or door tracks of the auto rack car. Workers step in this grease and then track the grease into the new vehicles. Thus, the grease sometimes damages the interior carpeting in the new vehicles.

The Association of American Railroads ("AAR") requires that the door locks and rollers be lubricated or greased every twelve months or sooner if necessary. The AAR also requires that the date on which the doors and rollers are lubricated be painted on the inside of the auto rack cars for tracking purposes. This requires extensive tracking procedures for this regular maintenance which increases the cost of operating the auto rack cars and decreases the efficiency of the use of the auto rack cars.

Accordingly, there is a need for a new door lock for railroad cars, and in particular auto rack cars, which does not need to be lubricated on a regular basis.

SUMMARY OF THE INVENTION

The present invention solves the above problems by providing a lubricant-free door lock for railroad cars and particularly auto rack railroad cars, which eliminates the need to use grease or other lubricants to lubricate the door locks. The lubricant-free door lock of the present invention generally includes a stainless steel or aluminum cylindrical tube or housing and a cylindrical replaceable plastic bushing, bearing member or collar (primarily referred to herein as a "bushing") mounted in the housing to prevent the metal-on-metal contact between a stainless steel or aluminum locking pin and the inner walls of the housing. The bushing is preferably molded from a polymer such as an ultra high molecular weight (UHMW) polyethylene although it could be made from other suitable materials such as manganese, bronze, ceramics, moly disulfide filled nylon, delrin or urethane. The bushing eliminates the need for a lubricant between the steel locking pin and the steel inner walls of the housing.

A washer or plate connected to the bottom end of the housing maintains the bushing in the housing. The door lock also includes a spring mounted in the housing between the bushing and an end cap positioned over the locking pin. A limiter or stop extends transversely though the housing, end cap and locking pin to limit the movement of the locking pin.

It is therefore an object of the present invention to provide a lubricant free door lock for doors on railroad cars.

Another object of the present invention is to provide a door lock for doors on railroad cars which eliminates the need to lubricate the door locks.

Other objects, features and advantages of the present invention will be apparent from the following detailed disclosure, taken in conjunction with the accompanying sheets of drawings, wherein like reference numerals refer to like parts.

BRIEF DESCRIPTION OF THE DRAWINGS

FIG. 3 is a perspective view of an assembled lubricant free door lock of the present invention.

FIG. 4A is a side elevation view of the door lock of the present invention.

FIG. 4B is a top plan view of the door lock of the present invention.

FIG. 5 is a perspective view of the end cap of the door lock of the present invention.

FIG. 6 is a perspective view of the housing of the door lock of the present invention.

DETAILED DESCRIPTION OF THE INVENTION

Figure 2:
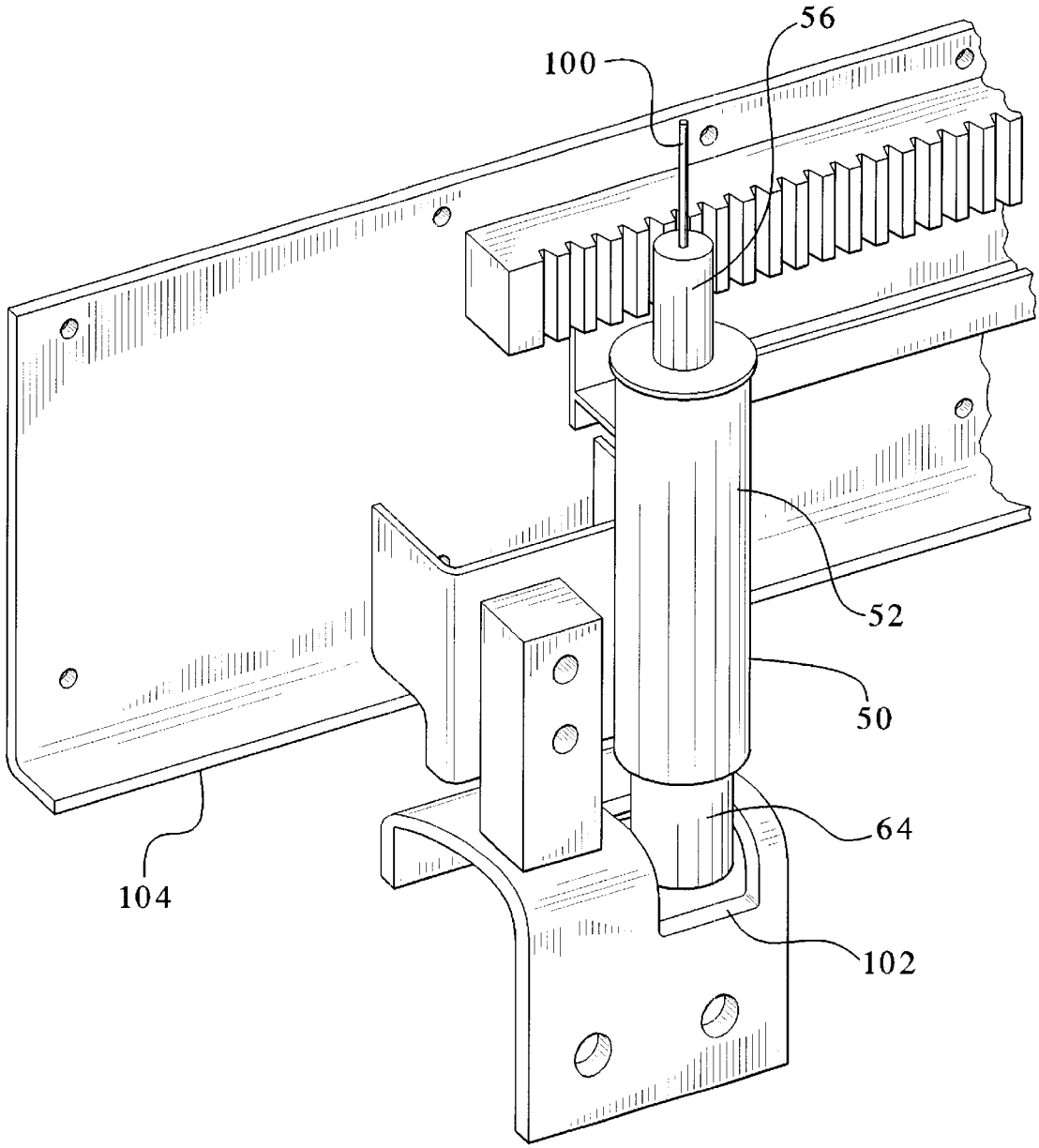
FIG. 2 is a perspective view of a door lock of the present invention coacting with a lower locking socket on a railroad car.
Figure 7:
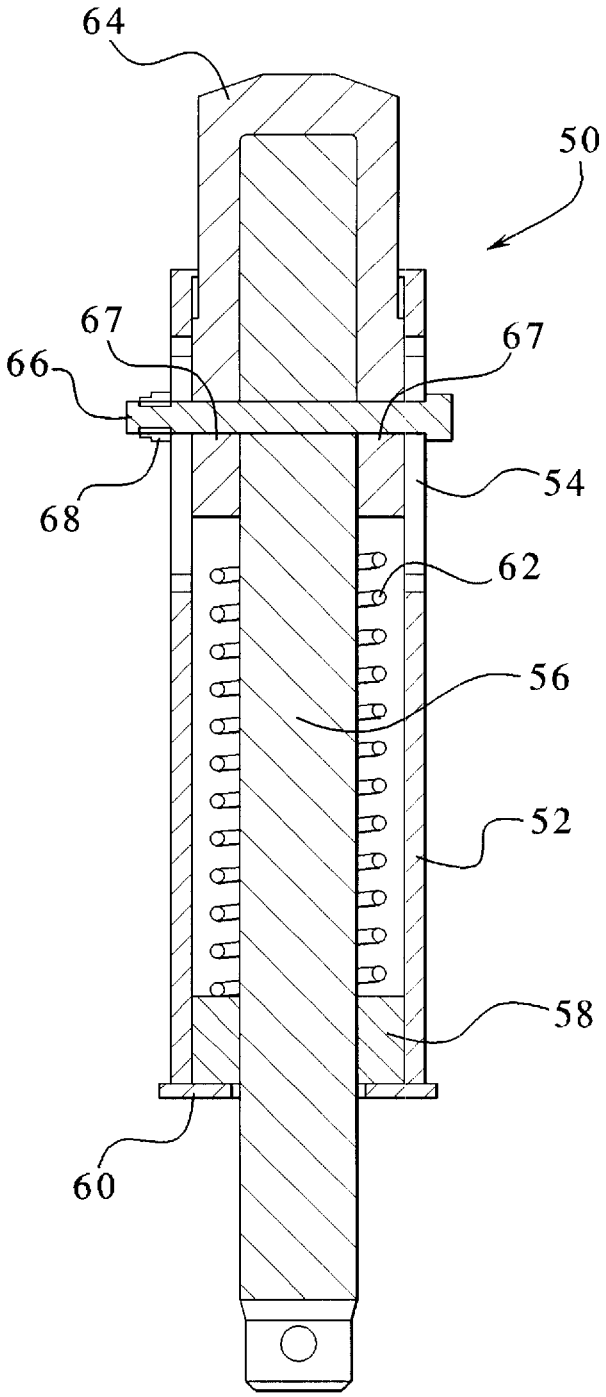
FIG. 7 is a vertical cross-sectional view of the door lock of the present invention taken substantially though line 7—7 of FIG. 4B.
Figure 8:
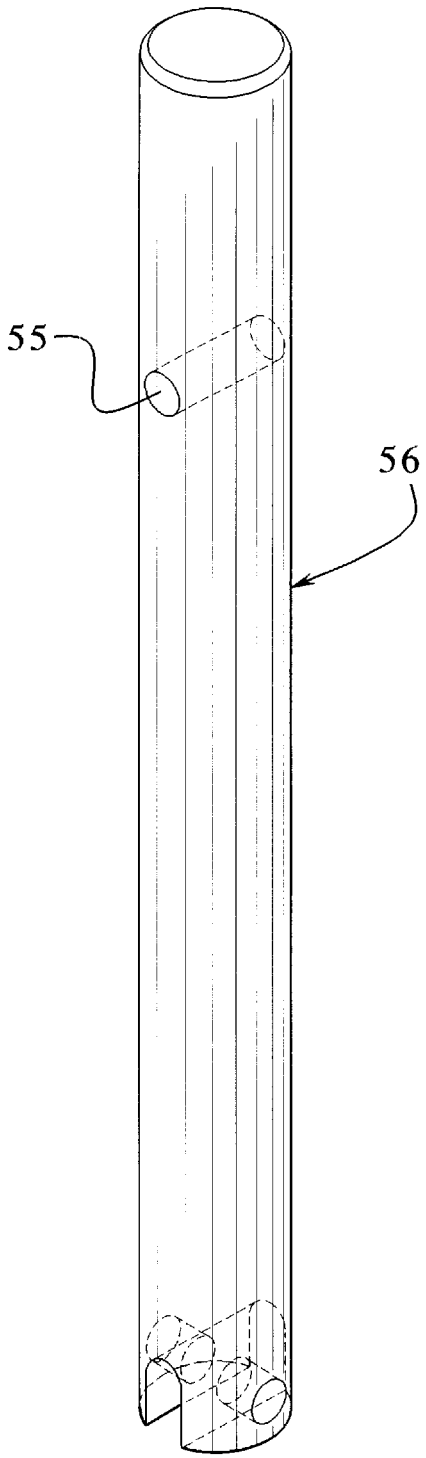
FIG. 8 is perspective view of the locking pin of the door lock of the present invention.
Figure 9:
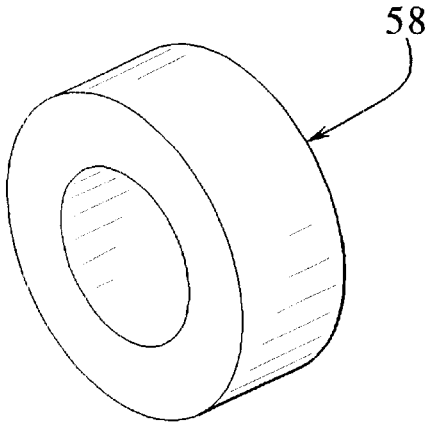
FIG. 9 is a perspective view of the bushing of the door lock of the present invention.
Figure 10:
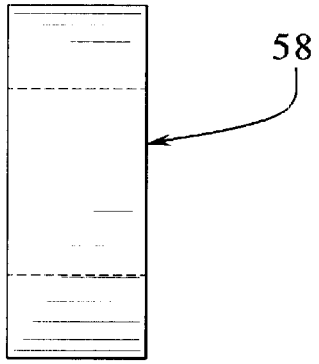
FIG. 10 is a side view of the bushing of the door lock of the present invention.
Figure 11:
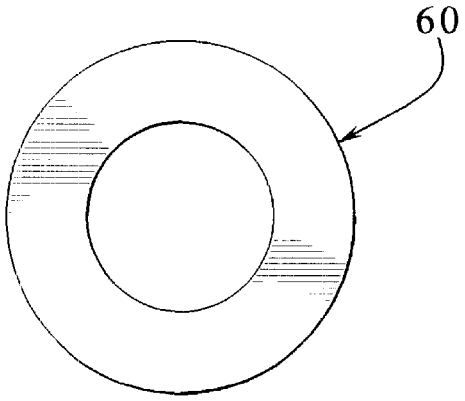
FIG. 11 is a top plan view of the washer of the door lock of the present invention.

The lubricant free door lock of one embodiment of the present invention eliminates the need to lubricate door locks on doors in enclosed railroad cars. A lubricant free door lock of the present invention is described in detail below in relation to auto rack cars, although the present invention is also suited for box cars and other railroad cars. A lower door lock is illustrated in FIG. 2; however it should be appreciated that the door lock is adapted to be used as an upper door lock on railroad cars.

Figure 1:
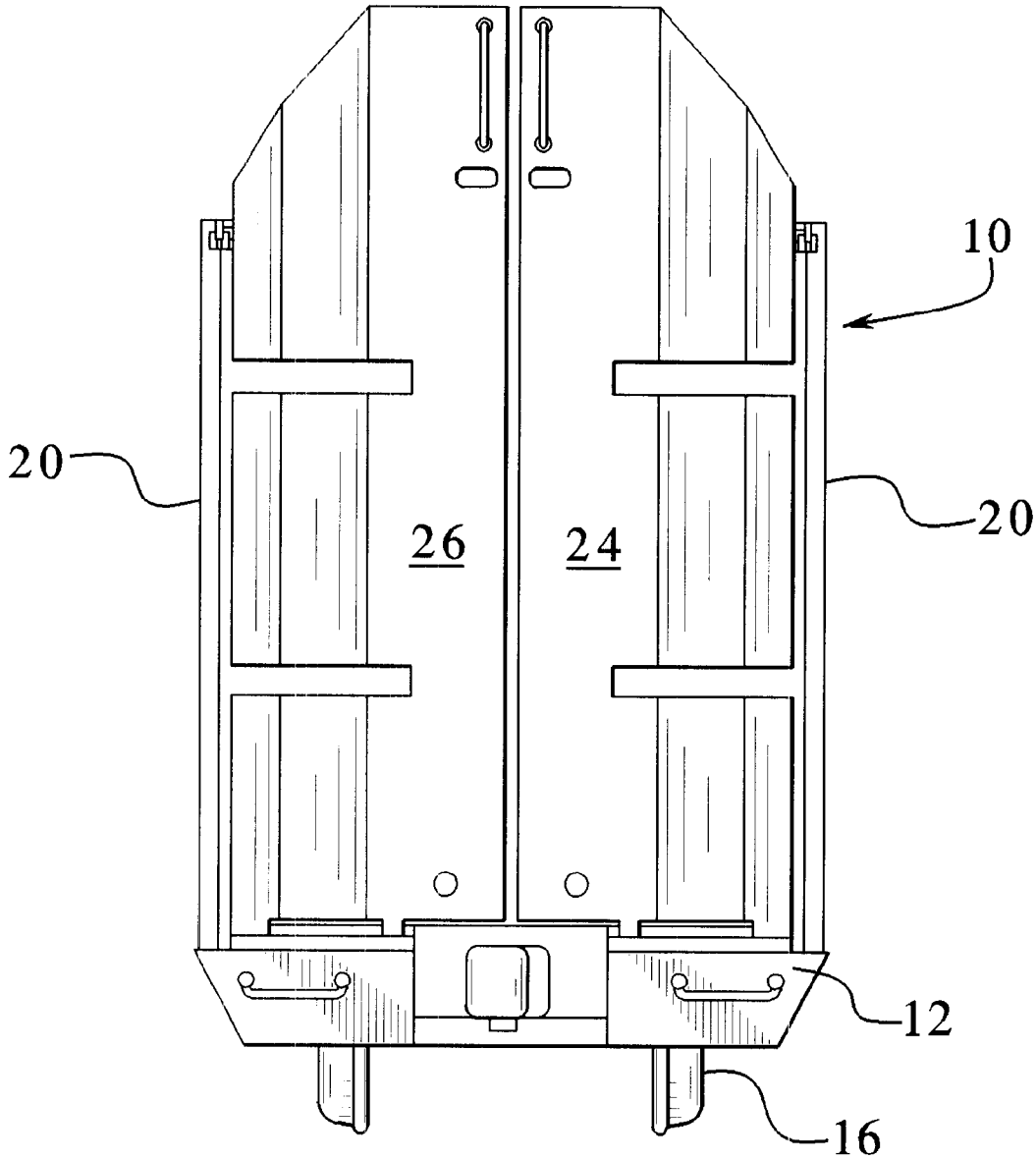
FIG. 1 is an end view of an auto rack railroad car.

Referring now to the drawings, and particularly to FIG. 1, a typical auto rack car 10 includes a frame 12 supported by trucks (not shown), each of which have several wheels 16 which roll along railroad tracks. The frame 12 supports two sidewalls 20 and a roof 22. The auto rack car 10 includes a pair of coacting clamshell doors 24 and 26 mounted on each end of the auto rack car 10. The doors 24 and 26 are opened to facilitate the loading and unloading of vehicles into and out of the auto rack car 10 and are closed during transport or storage of the vehicles. The right hand door 24 and the left-hand door 26 (when viewed from the outside of the car) are shown in closed position in FIG. 1.

Referring now to FIGS. 2 through 11, one embodiment of a lubricant-free door lock 50 of the present invention includes a substantially cylindrical tube or housing 52 having spaced-apart slots 54 vertically extending in the wall of the tube. The housing 52 is suitably sized to receive a cylindrical locking pin 56. A cylindrical bushing 58 is mounted in the bottom portion of the housing 52 and is held in place by a washer 60 or other suitable member which is suitably connected (i.e., preferably welded) to the bottom end of the housing 52. A spring or biasing member 62 is journaled about the locking pin 56, mounted in the housing 52 and abuts the top of the bushing 58. An end cap 64 is mounted over the locking or working end of the locking pin 56. The end cap 64 partially extends inside the housing 52 and partially outside the housing. The end of the end cap 64 in the housing abuts against the top of the spring 62. A fastening or movement limiting pin, limiter or stop 66 extends though the slots 54 in the housing 52, an aperture in the end cap 64 and a hole in the locking pin 56 as specifically illustrated in FIG. 7 to limit the movement of the locking pin and to secure such parts together. The fastening pin could be replaced by any other suitable member such as a roll pin or a clevis pin. A nut 68 maintains the pin 66 in place. This assembly enables easy and quick disassembly of the door lock 50 for cleaning and replacement of the parts, such as the end cap and the bushing.

An actuating lever, line, cable or member 100 is suitably attached to the bottom of the locking pin 56 to activate the locking pin and end cap. As illustrated in FIG. 2, in operation when upward force is applied to the locking pin 56 and end cap 64, the end cap disengages the socket 102 (see FIG. 2) to release the door 104. The bottom end of the end cap engages the spring to limit the movement of the end cap. The locking pin and end cap are pushed against the spring and the spring biases the locking pin and end cap toward their normal position. The bushing 58 and the end cap 64 prevent metal-to-metal contact between the locking pin and the housing. The end cap 64 also prevents metal-to-metal contact between the door lock and the metal socket 102. This reduces the wear on the door lock as well as the socket.

More specifically, the bushing and the end cap are each preferably molded from an ultra-high molecular weight polyethylene, although they could be made in other suitable manners (such as by machining or injection molding) and from other suitable materials such as delrin, urethane, moly disulfide filled nylon, manganese, bronze and ceramics. The bushing and the end cap preferably each have a low coefficient of friction to steel, dry self-lubricating and non-hygroscopic characteristics, a high compressive strength and a high resistance to wear. Although the bushing and end cap are usually protected from direct sunlight, the bushing and the end cap each could include an ultraviolet inhibitor.

Accordingly, the bushing prevents metal-to-metal contact between the housing and the locking pin. The end cap serves as a further bushing and co-acts with the bushing 58 to prevent metal-to-metal contact between the housing and the locking pin, prevents wear to the locking pin and also prevents wear to the socket 102.

It will be understood that modifications and variations may be effected without departing from the scope of the novel concepts of the present invention, and it is understood that this application is to be limited only by the scope of the claims.

The invention is claimed as follows:

1. A lubricant-free door lock for a railroad car, said door lock comprising:

a tubular housing;

a bushing mounted in the housing, wherein the bushing is made from a material selected from the group consisting of: polyethylene, delrin, urethane, moly disulfide filed nylon, manganese, bronze, ceramics and combinations thereof;

a locking pin slidably mounted in the housing and extending through the bushing;

an end cap mounted on an end of said locking pin opposite the bushing and at least partially slidably mounted in said housing, wherein the bushing and end cap co-act to prevent the locking pin from directly engaging the housing;

a limiter connected to the housing, locking pin and end cap for limiting the movement of the locking pin and end cap relative to the housing; and a biasing member positioned in the housing between the bushing and end cap for biasing the end cap from the bushing.

2. The door lock of claim 1, wherein the housing is substantially cylindrical.

3. The door of lock of claim 1, wherein the biasing member is a spring journaled about the locking pin.

4. The door lock of claim 1, wherein the bushing is made of a dry, self-lubricating and non-hygroscopic material.

5. The door lock of claim 4, wherein the end cap is made of a dry, self-lubricating and non-hygroscopic material.

6. The door lock of claim 5, wherein the end cap is made from a material selected from the group consisting of polythylene, delrin, urethane, moly disulfide filed nylon, manganese, bronze, ceramics and combinations thereof.

7. the door lock of claim 1, wherein the bushing and the end cap are made of a dry self-lubricating and non-hygroscopic material.

8. The door lock of claim 1, wherein the end cap is made of a dry, self-lubricating and non-hygroscopic material.

9. The door lock of claim 8, wherein the end cap is made from a material selected from the group consisting of polythylene, delrin, urethane, moly disulfide filed nylon, manganese, bronze, ceramics and combinations thereof.

10. The door lock of claim 1, wherein the end cap is made of ultra high molecular weight polyethylene.

11. A lubricant-free door lock for a door on a railroad car, said door lock comprising:

a tubular housing having a wall which includes a top portion, a bottom portion, a central opening defined by the wall extending the length of the housing, and spaced-apart slots in the wall extending along the length of the housing;

a locking pin, having a hole and a locking end, sized to fit into the central opening of the housing;

a bushing, having a top and a bottom, mounted in the bottom portion of the wall of the housing;

a spring, having a top portion and a bottom portion, journaled about the locking pin, mounted in the housing and abutting the top of the bushing;

an end cap, having horizontally aligned apertures, a top end and a bottom end, mounted over the locking end of the locking pin, wherein said end cap partially extends inside the top portion of the housing and partially outside the top portion of the housing and wherein the bottom end of said end cap in the housing abuts against the top portion of the spring; and a fastening pin extending through the slots in the housing, the apertures in the end cap and the hole in the locking pin.

12. The door lock of claim 11, wherein the fastening pin is maintained in place by a nut.

13. The door lock of claim 11, wherein the bushing is made of a dry, self-lubricating and non-hygroscopic material.

14. The door lock of claim 13, wherein the bushing further includes an ultraviolet inhibitor.

15. The door lock of claim 13, wherein the bushing is made of ultra high molecular weight polyethylene.

16. The door lock of claim 13, wherein the bushing further includes an ultraviolet inhibitor.

17. The door lock of claim 11, wherein the bushing is made from a material selected from the group consisting of polyethylene, delrin, urethane, moly disulfide filed nylon, manganese, bronze, ceramics and combinations thereof.

18. The door lock of claim 11, wherein the end cap is made of a dry, self-lubricating and non-hygroscopic material.

19. The door lock of claim 18, wherein the end cap includes an ultraviolet inhibitor.

20. The door lock of claim 18, wherein the end cap the end cap is made of ultra high molecular weight polyethylene.

21. The door lock of claim 18, wherein the end cap includes an ultraviolet inhibitor.

22. The door lock of claim 11, wherein the end cap is made from a material selected from the group consisting of polythylene, delrin, urethane, moly disulfide filed nylon, manganese, bronze, ceramics and combinations thereof.

23. The door lock of claim 11, wherein the bushing and end cap are made of a dry, self-lubricating and non-hygroscopic material.

24. A lubricant-free door lock for a railroad car, said door lock comprising:

a tubular housing;

a bushing mounted in the housing;

a locking pin slidably mounted in the housing and extending through the bushing;

an end cap mounted on an end of said locking pin opposite the bushing and at least partially slidably mounted in said housing, wherein the bushing and end cap co-act to prevent the locking pin from directly engaging the housing, and wherein the end cap is made from a material selected from the group consisting of polyethylene, delrin, urethane, moly disulfide filed nylon, manganese, bronze, ceramics and combinations thereof;

a limiter connected to the housing, locking pin and end cap for limiting the movement of the locking pin and end cap relative to the housing; and a biasing member positioned in the housing between the bushing and end cap for biasing the end cap from the bushing.

25. The door lock of claim 24, wherein the housing is substantially cylindrical.

26. The door of lock of claim 24, wherein the biasing member is a spring journaled about the locking pin.

27. The door lock of claim 24, wherein the bushing is made of a dry, self-lubricating and non-hygroscopic material.

28. The door lock of claim 24, wherein the bushing is made from a material selected from the group consisting of: polyethylene, delrin, urethane, moly disulfide filed nylon, manganese, bronze, ceramics and combinations thereof.

29. The door lock of claim 24, wherein the bushing is made of ultra high molecular weight polyethylene.

30. A lubricant-free door lock for a railroad car, said door lock comprising:

a tubular housing;

a bushing mounted in the housing, wherein the bushing is made of ultra high molecular weight polyethylene;

a locking pin slidably mounted in the housing and extending through the bushing;

an end cap mounted on an end of said locking pin opposite the bushing and at least partially slidably mounted in said housing, wherein the bushing and end cap co-act to prevent the locking pin from directly engaging the housing;

a limiter connected to the housing, locking pin and end cap for limiting the movement of the locking pin and end cap relative to the housing; and a biasing member positioned in the housing between the bushing and end cap for biasing the end cap from the bushing.

31. The door lock of claim 30, wherein the housing is substantially cylindrical.

32. The door of lock of claim 30, wherein the biasing member includes a spring journaled about the locking pin.

33. The door lock of claim 30, wherein the end cap is made of a dry, self-lubricating and non-hygroscopic material.

34. The door lock of claim 30, wherein the end cap is made from a material selected from the group consisting of polyethylene, delrin, urethane, moly disulfide filed nylon, manganese, bronze, ceramics and combinations thereof.

35. A lubricant-free door lock for a railroad car, said door lock comprising:

a tubular housing;

a bushing mounted in the housing;

a locking pin slidably mounted in the housing and extending through the bushing;

an end cap mounted on an end of said locking pin opposite the bushing and at least partially slidably mounted in said housing, wherein the bushing and end cap co-act to prevent the locking pin from directly engaging the housing, wherein the end cap is made of ultra high molecular weight polyethylene;

a limiter connected to the housing, locking pin and end cap for limiting the movement of the locking pin and end cap relative to the housing; and a biasing member positioned in the housing between the bushing and end cap for biasing the end cap from the bushing.

36. The door lock of claim 35, wherein the housing is substantially cylindrical.

37. The door of lock of claim 35, wherein the biasing member is a spring journaled about the locking pin.

38. The door lock of claim 35, wherein the bushing is made of a dry, self-lubricating and non-hygroscopic material.

39. The door lock of claim 35, wherein the bushing is made from a material selected from the group consisting of: polyethylene, delrin, urethane, moly disulfide filed nylon, manganese, bronze, ceramics and combinations thereof.

40. The door lock of claim 35, wherein the bushing is made of ultra high molecular weight polyethylene.

41. A lubricant-free door lock for a railroad car, said door lock comprising:

a tubular housing defining spaced-apart slots extending along part of its length;

a bushing mounted in the housing, wherein the bushing is made from a material selected from the group consisting of: polyethylene, delrin, urethane, moly disulfide filed nylon, manganese, bronze, ceramics and combinations thereof;

a locking pin slidably mounted in the housing and extending through the bushing;

an end cap mounted on an end of said locking pin opposite the bushing and at least partially slidably mounted in said housing, wherein the bushing and end cap co-act to prevent the locking pin from directly engaging the housing;

a limiter extending through the slots in the housing, locking pin and end cap for limiting the movement of the locking pin and end cap relative to the housing; and a biasing member positioned in the housing between the bushing and end cap for biasing the end cap from the bushing.

42. The door lock of claim 41, wherein the housing is substantially cylindrical.

43. The door of lock of claim 41, wherein the biasing member is a spring journaled about the locking pin.

44. The door lock of claim 41, wherein the bushing is made of a dry, self-lubricating and non-hygroscopic material.

45. The door lock of claim 41, wherein the end cap is made of a dry, self-lubricating and non-hygroscopic material.

46. A lubricant-free door lock for a railroad car, said door lock comprising:

a tubular housing defining spaced-apart slots extending along part of its length;

a bushing mounted in the housing;

a locking pin slidably mounted in the housing and extending through the busing;

an end cap mounted on an end of said locking pin opposite the busing and at least partially slidably mounted in said housing, wherein the bushing and end cap co-act to prevent the locking pin from directly engaging the housing, wherein the end cap is made from a material selected from the group consisting of polyethylene, delrin, urethane, moly disulfide filed nylon, manganese, bronze, ceramics and combinations thereof;

a limiter extending through the slots in the housing, locking pin and end cap for limiting the movement of the locking pin and end cap relative to the housing; and a biasing member positioned in the housing between the bushing an end cap for biasing the end cap from the bushing.

47. A lubricant-free door lock for a railroad car, said door lock comprising:

a tubular housing defining spaced-apart slots extending along part of its length;

a bushing mounted in the housing, wherein the bushing is made of ultra high molecular weight polyethylene;

a locking pin slidably mounted in the housing and extending through the bushing;

an end cap mounted on an end of said locking pin opposite the bushing and at least partially slidably mounted in said housing, wherein the bushing and end cap co-act to prevent the locking pin from directly engaging the housing;

a limiter extending through the slots in the housing, locking pin and end cap for limiting the movement of the locking pin and end cap relative to the housing; and a biasing member positioned in the housing between the bushing and end cap for biasing the end cap from the bushing.

48. A lubricant-free door lock for a railroad car, said door lock comprising:

a tubular housing defining spaced-apart slots extending along part of its length;

a bushing mounted in the housing;

a locking pin slidably mounted in the housing and extending through the busing; an end cap mounted on an end of said locking pin opposite the busing and at least partially slidably mounted in said housing, wherein the bushing and end cap co-act to prevent the locking pin from directly engaging the housing, wherein the end cap is made of ultra high molecular weight polyethylene;

a limiter extending through the slots in the housing, locking pin and end cap for limiting the movement of the locking pin and end cap relative to the housing; and a biasing member positioned in the housing between the bushing an end cap for biasing the end cap from the bushing.

* * * * *